US006142841A

United States Patent [19]

Alexander, Jr. et al.

[11] Patent Number: 6,142,841

[45] **Date of Patent: *Nov. 7, 2000**

[54] WATERJET DOCKING CONTROL SYSTEM FOR A MARINE VESSEL

[75] Inventors: Charles F. Alexander, Jr., Austin, Tex.; David A. Schmitz, Reeseville, Wis.

[73] Assignee: Brunswick Corporation, Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/078,976

[22] Filed: May 14, 1998

[51] Int. Cl.[7] ..... B63H 11/00

[52] U.S. Cl. ..... 440/38; 114/151

[58] Field of Search ..... 440/38, 39, 47; 114/151

[56] References Cited

U.S. PATENT DOCUMENTS

| | | | |
|---|---|---|---|
| 2,145,493 | 1/1939 | Norquist | 114/151 |
| 2,330,674 | 9/1943 | Briggs | 114/151 |
| 3,675,611 | 7/1972 | Glass | 114/151 |
| 4,056,073 | 11/1977 | Dashew | 114/151 |
| 4,208,978 | 6/1980 | Eller | 114/151 |
| 4,294,186 | 10/1981 | Wardell | 114/151 |
| 4,412,500 | 11/1983 | Krautkremer | 114/151 |
| 4,423,696 | 1/1984 | Aker | 114/148 |
| 4,455,960 | 6/1984 | Aker | 114/151 |
| 4,531,920 | 7/1985 | Stricker | 440/47 |
| 4,549,868 | 10/1985 | Lolly | 440/42 |
| 4,732,104 | 3/1988 | Roestenberg | 114/151 |
| 4,747,359 | 5/1988 | Ueno | 114/144 B |
| 4,807,552 | 2/1989 | Fowler | 114/151 |
| 5,090,929 | 2/1992 | Rieben . | |
| 5,282,763 | 2/1994 | Dixon | 440/42 |
| 5,289,793 | 3/1994 | Aker | 114/151 |
| 5,401,195 | 3/1995 | Yocom . | |
| 5,501,072 | 3/1996 | Plancich | 60/221 |
| 5,522,335 | 6/1996 | Veronesi | 114/151 |
| 5,642,684 | 7/1997 | Aker | 114/151 |

OTHER PUBLICATIONS

Dickson Stern Thruster, Jan. 15, 1998.

"Vetus Bow Thrusters", Trade Only, Jan. 1998.

Dickson Stern Thruster.

Harbormaster Tunnel Thrusters.

*Primary Examiner*—Stephen Avila

*Attorney, Agent, or Firm*—Andrus, Sceales, Starke & Sawall, LLP; William D. Lanyi

[57] ABSTRACT

A maneuvering control system is provided which utilizes pressurized liquid at three or more positions of a marine vessel in order to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired. Electrical embodiments of the present invention can utilize one or more pairs of impellers to cause fluid to flow through outlet conduits in order to provide thrust on the marine vessel. In one embodiment of the present invention, a cross thrust conduit is associated with a marine vessel to direct fluid flow in a direction perpendicular to a centerline of the marine vessel and a pair of outlet conduits are associated with the marine vessel to direct flows of fluid in directions which are neither parallel nor perpendicular to a centerline of the marine vessel. In this embodiment, reversible motors are used to rotate associated impellers in either forward or reverse directions. In any of the embodiments of the present invention, a joy stick control can be used to select or deselect each of the outlet conduits and, in certain embodiments, to select the direction of operation of an associated reversible motor.

30 Claims, 11 Drawing Sheets

WATERJET DOCKING CONTROL SYSTEM FOR A MARINE VESSEL

BACKGROUND OF THE INVENTION

1. Field of the Invention

The present invention is generally related to a waterjet maneuvering system for a marine vessel and, more particularly, to a system that uses three or more streams of water in a coordinated manner to maneuver a marine vessel into a desired position on a body of water.

2. Description of the Prior Art

Many different devices are known to those skilled in the art for maneuvering a marine vessel. Certain marine vessels, because of their size, can pose particularly difficult problems during docking procedures. Various kinds of bow thrusters, stern thrusters, and other auxiliary propulsion devices have been used in the past to assist in maneuvering large marine vessels.

U.S. Pat. No. 4,549,868, which issued to Lolly on Oct. 29, 1985, discloses a jet propulsion system for boats. The jet actuated boat propulsion device is provided for driving the boat in areas where hyacinth or other water vegetation exists, and which normally would foul the operation of an outboard or inboard motor. A water pump positioned in a well in the bottom of a boat and communicating with the water in which the boat is floating is connected through conduits to discharge a jet of water through a nozzle extending into the body of water in which the boat is floating. The jettisoned water is discharged into the body of water and exerts a jet action or thrust which drives the boat through the water. The difficulties which have heretofore been encountered in propelling boats in areas where hyacinth or other water plants exist have thus been virtually eliminated because the discharge pipe for the water being jettisoned projects into the body of water at an angle, and therefore the hyacinth and other water plants slip off the pipe for the jettisoned water and exerts a forward thrust on the boat from an area beneath the surface of the water in which the boat is floating. A modified form includes a motor driven pump connected to twin pipes, one of which is a water inlet and the other pipe is the jet pipe to drive the boat through the water.

U.S. Pat. No. 4,807,552, which issued to Fowler on Feb. 28, 1989, describes a small boat bow thruster. The thruster includes a port and starboard discharge nozzle forwardly mounted through the hull of the boat and above the waterline. Water from an inlet port located below the waterline of the boat is drawn by a pump through conduits to the discharge nozzles. The pump is a by-directional positive displacement pump which can feed either the starboard or port discharge nozzle depending on the direction of pump rotor rotation. The pump is powered by an electric motor capable of running in a normal or reverse mode and which is controlled by an activation switch manually operated. Water is discharged through the port or starboard nozzle above the waterline of the boat when the system is activated. The bow is thrust sideways in the direction opposite of the nozzle discharge allowing slow and controlled maneuvering of the boat in tight spaces.

U.S. Pat. No. 4,056,073, which issued to Dashew et al on Nov. 1, 1977, discloses a boat thruster which includes a diverter valve with an inlet connected to a water pump, a pair of outlets extending to either side of the boat, a valve mechanism for accurately controlling the amount of thrust obtained from both outlets, and a deflector positioned at each outlet. Each deflector is moveable between a first position wherein it allows sideward water discharge to thrust the bow to the side, and a second position where it directs water rearwardly to move the boat in a forward direction, or if required, to a third position to move the boat rearwardly.

U.S. Pat. No. 5,289,793, which issued to Aker on Mar. 1, 1994, discloses a heliconic thruster system for a marine vessel. The thruster system is provided for maneuvering or propulsion of a marine vessel through the use of directionally oriented waterjets discharged tangentially from a helical-conical flow chamber. The thruster system includes a high capacity pump for pumping water through a hull intake to the flow chamber with a substantial helical or swirling action. The water exists the flow chamber through one or more of a plurality of tangentially oriented discharge conduits having discharge nozzles for passage of high velocity waterjets through the hull, resulting in reaction forces used to maneuver or propel the vessel. Each discharge conduit includes a valve member moveable between open and closed positions for respectively permitting or preventing water flow to the associated nozzle.

U.S. Pat. No. 4,208,978, which issued to Eller on Jun. 24, 1980, describes a lateral thruster for a water vessel. The bow thruster comprises a submersible axial flow pumping unit mounted on the outside of the vessel at the bow to be raised to an inoperative position out of the water or lowered to an operative position in the water with its water flow axis perpendicular to the longitudinal centerline of the vessel. The pumping unit is reversible, and it includes a hydraulic motor and a pump impeller inside an annular housing provided with gate valves at its opposite ends. The gate valve at the discharge end restricts the flow there to increase the thrust produced by the pump. A directional control and a fluid pressure source for the hydraulic motor in the submersible pump unit are onboard the vessel.

U.S. Pat. No. 4,294,186, which issued to Wardell on Oct. 13, 1981, discloses a retractable bow thruster. The device comprises a main support housing which is secured to the hull of a vessel. An opening is made within the lower portion of the housing through the vessel hull to allow a thruster drive assembly to lower into operative position. The drive assembly includes an upper gear housing which mounts in a drive gear. The upper gear housing is pivotally mounted for rotation about the axis of rotation of the drive gear. The opposite end of the upper gear housing is pivotally attached to a vertically displaceable lower gear housing which mounts an idler gear and a propeller. The idler gear drives a ring gear disposed about the propeller. When the upper gear housing is moved about its pivot access, the lower gear housing moves vertically causing the propeller to move from a recessed position to an operative position below the bow of the boat to provide lateral thrust to the boat.

U.S. Pat. No. 5,522,335, which issued to Veronesi on Jun. 4, 1996, describes a combined azimuthing and tunnel auxiliary thruster powered by integral and a canned electrical motor. The thruster is intended for use by a marine vessel and includes a submersible propulsion unit which has a shroud with a propeller rotatably mounted therein. A canned electric motor is mounted between the propeller and the shroud for rotating the propeller to create thrust. A propulsion unit deploying and rotating mechanism is mounted on the hull and on the propulsion unit. The propulsion unit deploying and rotating mechanism is operable to extend the propulsion unit out of the hull and retract it into the hull and to rotate the propulsion unit to direct the thrust generated thereby in any direction when the thruster is in the deploy position. When the thruster is retracted, it is positioned with a tunnel extending transversely through the hull. Rotation of the propeller while in the retracted position generates laterally directed thrusts through the tunnel.

U.S. Pat. No. 5,282,763, which issued to Dixon on Feb. 1, 1994, describes a steerable bow thruster for swatch vessels. The bow thruster system is located substantially within the pontoons of a semisubmerged vessel exclusive of a rotating nozzle which is located on the upper side of the pontoons. The rotating nozzle can turn in any direction and allows the steerable bow thruster system to thrust forward, aft, side to side, and in any direction in between to allow the semisubmerged vessel to maneuver freely and within the assistance of the main engines. To minimize draft and to prevent ecological harm, the nozzles are installed on the top of the pontoons allowing the pontoons to act as a barrier to keep thrust wash from disturbing shallow ocean bottoms and reefs over which the vessel may be operating. The propeller means may be shrouded to prevent harm or injury is to swimmers who may be in the water. A rudder may also be coupled to the thruster nozzle to provide directional control for the semisubmerged vessel when it is underway at higher speeds. The nozzle of the propelling means may be located forward of the center of lateral resistance of the semisubmerged vessel.

U.S. Pat. No. 4,732,104, which issued to Roestenberg on Mar. 22, 1988, discloses a bow thruster that is pivotal and adapted to be adjustably pivoted about a stem of a boat, which enhances attainment of smooth, save docking of the boat, with better control, and minimal difficulty. The bow thruster comprises two propellers which, when spinning, thrust the bow of the boat to starboard or to port and a mechanism for pivoting the propellers about the stem of the boat. This pivoting mechanism comprises a pivoting arm coupled to the propeller unit and a gear train which, when activated, rotates the pivoting arm.

U.S. Pat. No. 5,642,684, which issued to Aker on Jul. 1, 1997, describes a thrust director unit for a marine vessel. The improved thrust director unit is provided for discharging a directionally adjustable waterjet flow from the hull of a marine vessel to generate a thrust reaction force for close quarter maneuvering and/or propulsion of the vessel. The unit comprises a thruster housing having an outlet through which the jet flow is discharged, wherein the outlet is defined by diverging fore-aft walls to permit angularly forward or rearward jet flow discharge for vessel propulsion. At least two deflector veins are moveable together within the housing outlet and cooperate there with to define a directionally adjustable discharge flow path for selective jet flow discharge in a sideward direction to produce a sideward thrust, or in a forwardly or rearwardly angled direction to respectively produce a reverse or forward propulsion thrust. In the sideward thrust position, the discharge flow path has a non-diverging cross-section and is isolated from the diverging fore-aft walls of the housing outlet.

U.S. Pat. No. 4,747,359, which issued to Ueno on May 31, 1988, discloses an apparatus for controlling the turn of a ship. When the right turn or left turn is set by operating one joystick lever, the bow thruster arrangement on the bow side generates the drift thrust in the rightward or leftward direction in accordance with the turning angular velocity on the bases of the operation of the joystick lever. At the same time, the propellers provided on the stern side are controlled so as to generate backward thrusts proportional to the absolute value of the turning angular velocity of the ship. The forward thrust of the ship which is caused due to the generation of the drift thrust by the bow thruster is suppressed. Thus, the ship is turned to the right or left around the stern as a rotational center at a predetermined speed with the position of the hull held.

U.S. Pat. No. 4,455,960, which issued to Aker on Jun. 26, 1984, describes a fluid valve actuated boat thruster. The boat thruster system includes a pump for drawing water through an inlet in the boat hull and for discharging water through first and second pipes connected to outlets located on either side of the hull. A valve is installed in each of the pipes to control the flow of water therethrough. The valves may be controlled by either an open or closed loop control system configured so as to prevent both outlet pipes from being closed at the same time during system operation. Each valve is preferably comprises of multiple veins, each of which is mounted for rotation about an off-center axis such that in the event of a valve control system failure, the water flow will cause the valve to open rather than close thereby preventing undesirable high pressure buildup in the system.

U.S. Pat. No. 4,412,500, which issued to Krautkremer on Nov. 1, 1983, describes a drive mechanism for ships or the like comprising a main propeller and an auxiliary mechanism. The drive mechanism for ships having at least one main propeller or the like is driveable by at least one main rotor and further has at least one driveable auxiliary mechanism, for example a maneuvering propeller. An energy producer is driveable by the main motor. A further motor is driven by the energy producer and arranged for driving the driveable auxiliary mechanism. An adjusting mechanism is provided for adjusting energy emitted by the energy producer or absorber by the further motor. A regulator adjusts the adjusting mechanism to a pre-selected energy output. The main motor and the auxiliary mechanism are sized such that in the higher part of the speed range of the main motor, the sum of the energy required to drive the propulsion means at that speed and simultaneously drive the auxiliary mechanism at that speed, exceed the output available from the main motor.

U.S. Pat. No. 5,501,072, which issued to Plancich et al on Mar. 26, 1996, discloses a combined centrifugal and paddle-wheel side thruster for boats. The propulsion mechanism for a boat includes an outlet conduit extending athwartships from a first outlet port to a second outlet port in the hull. A paddle-wheel impeller is mounted within the hull for rotation about an axis of rotation by a reversible motor. A circumferential paddle portion of the paddle-wheel impeller extends into an aperture defined centrally in the top wall of the outlet conduit. An inlet conduit extends athwartships from a first inlet port to a second inlet port, and intermediate thereof supplies water to the center of the paddle-wheel impeller. Water is discharged from the paddle-wheel impeller through one of the outlet ports, dependent upon the direction of rotation of the paddle-wheel impeller, to create thrust by a combined paddle-wheel and centrifugal pump action.

U.S. Pat. No. 4,531,920, which issued to Stricker on Jul. 30, 1985, describes a transverse waterjet propulsion system with auxiliary inlets and impellers. The waterjet propulsion system is disclosed having a transversely mounted engine driving one or more pumps with multiple inlets located so a great flow is available at low speed, subplaning operations, but at higher planing speeds, some inlets vent and a reduced flow is delivered to the pumps.

U.S. Pat. No. 4,423,696, which issued to Aker on Jan. 3, 1984, discloses an improved boat thruster system including swirl reducing veins. The system includes a pump for drawing water through an inlet in the boat hull and for discharging water through outlets on both sides of the hull. The improved system includes a plurality of substantially planer veins mounted in the water flow path proximate two said outlets. The veins function to reduce swirl angle components in the waterflow and thus increase thrust efficiency and prevent the ingestion of water borne debris into the outlets.

All of the United States patents identified and described above are hereby explicitly incorporated by reference in this description.

Known types of bow thrusters are commercially available from Vetus and are advertised as being available in various styles which provide various magnitudes of thrust and are constructed in many different sizes and shapes. Known types of stern thrusters are available from Dickson for boat lengths from 25 feet to 150 feet and with thrust magnitudes from 125 pounds to 1,500 pounds. Tunnel thrusters are available from Harbormaster in horsepower ratings from 150 horsepower to 3,000 horsepower and thrust magnitudes from 4,500 pounds to 66,000 pounds.

Many types of bow thrusters and stern thrusters are typically designed for marine vessels that are relatively large in size and, as a result, they are generally used on vessels larger than 25 feet in length. The use of standard bow thrusters and stern thrusters on smaller marine vessels is usually inhibited because of the relative costs of the conventional thrusters.

Marine vessels smaller than 25 feet in length can also present docking problems under certain circumstances. Most particularly, a youthful boat operator, an inexperienced adult operator of a boat may lack the necessary skills to maneuver a boat into a proper docking position by using only the primary propulsion system of the marine vessel. It would therefore be significantly beneficial if a relatively inexpensive maneuvering system could be incorporated in a marine vessel less than 25 feet in length so that an inexperienced or youthful boat operator could more easily maneuver the boat into a docking position. It would also be particularly beneficial if a control system could be provided for a maneuvering jet propulsion system that allows the boat operator to easily select the direction in which the boat is to move, turn, or rotate without having to translate that desired movement into a complicated series of actions in order to result in the desired movement of the vessel.

SUMMARY OF THE INVENTION

The present invention provides a marine propulsion system that comprises a source of pressurized liquid, such as water, and a plurality of outlet conduits. It also comprises a plurality of distribution conduits, each of which is connected in fluid communication with an associated one of the plurality of outlet conduits. A liquid distribution controller is connected in fluid communication with each of the plurality of distribution conduits and is connected in fluid communication with the source of pressurized water. Each of the plurality of outlet conduits is attachable to a marine vessel at preselected locations to direct a stream of water, which is flowing through associated ones of pluralities of distribution conduits and outlet conduits, in a predetermined direction associated with each of the outlet conduits for the purpose of imposing one or more forces on the marine vessel in directions opposite to the predetermined direction in which the streams of water flow through the outlet conduits.

The source of pressurized water can be a water pump or, alternatively, the source of pressurized liquid can be the jet pump used as a primary propulsion system for the marine vessel. Each of the plurality of outlet conduits can comprise a nozzle for directing the stream of water in the predetermined direction.

The marine propulsion system can comprise a liquid distribution controller which, in turn, comprises a stationary member and a moveable member which is controllable by the operator of a marine vessel. The plurality of distribution conduits are disposed to pass between portions of the stationary and moveable members so that relative movement between the stationary and moveable members in any direction will cause the plurality of distribution conduits to be selectively constricted and dilated according to a predetermined pattern.

The marine vessel has a centerline extending from its bow to its stem. The predetermined direction for each of the outlet conduits can be both in non-parallel and nonperpendicular relation with the centerline. The first two outlet conduits are attached near the bow of the marine vessel, and a second two outlet conduits are attached near the stern of the marine vessel. Each of the first two outlet conduits can be positioned to direct the stream of water in predetermined directions which have a rearward component. The second two outlet conduits can be positioned to direct their stream of water in predetermined directions which have a forward component. Alternatively, the first two outlet conduits can direct their stream of water in directions which have a forward component, and the second two outlet conduits can be positioned to direct their stream of water in predetermined directions which have a rearward component.

An alternative embodiment of the present invention provides a plurality of outlet conduits which are each attachable to a marine vessel at preselected locations in order to direct a stream of liquid in a predetermined direction associated with each of the outlet conduits. This imposes forces on the marine vessel in directions which are opposite to the predetermined direction of the fluid streams.

A means is provided for causing the steam of liquid to flow through a preselected one or more of the plurality of outlet conduits. In the alternative embodiment of the present invention, the causing means comprises a plurality of motors that are electrically controllable from an external source. A direction controller is provided for selecting and activating the causing means associated with the preselected one or more of the outlet conduits. The outlet conduits are directed in nonparallel and nonperpendicular directions in relation to the centerline of the marine vessel which extends from its bow to its stern.

In another embodiment of the present invention, a pair of outlet conduits is arranged to direct streams of water in directions which are non-parallel and nonperpendicular with the centerline of the marine vessel and a cross thrust outlet conduit is attached to the marine vessel at a preselected location to direct a stream of liquid in a perpendicular direction to the centerline of the marine vessel. Each of the conduits is provided with an impeller and a reversible motor that allows the system to cause water to flow through the conduits in either of two opposite directions, depending on the direction of operation of the reversible motor. By selecting one or more of the reversible motors for operation and also selecting the direction of operation of the reversible motor, the system can cause a stream of liquid to flow through the preselected one or more of the cross thrust conduits and pair of outlet conduits to maneuver the vessel. A direction controller, which can comprise a joy stick, is used for selecting and activating the causing means associated with the preselected one or more of the pair of outlet conduits and the cross thrust conduit. The direction controller can comprise a stationary member and a movable member which is controllable by an operator of the marine vessel, wherein the relative positions of the stationary and movable members determines the activation and deactivation of the cross thrust conduit and each of the pair of outlet conduits.

Furthermore, the relative positions of the stationary and movable members also determines the direction of operation of the reversible motors of the cross thrust conduits and each of said pair of outlet conduits.

As a result of the construction of the present invention, a marine vessel operator can manipulate a joystick or similarly constructed control device to coordinate the streams of water emitted from the outlet conduits in order to easily maneuver the marine vessel into a desired position. The maneuvering procedure can comprise forward or backward movement of the vessel, sideward movement of the vessel, or rotation of the vessel in either the clockwise or counterclockwise direction about an effective center of rotation.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
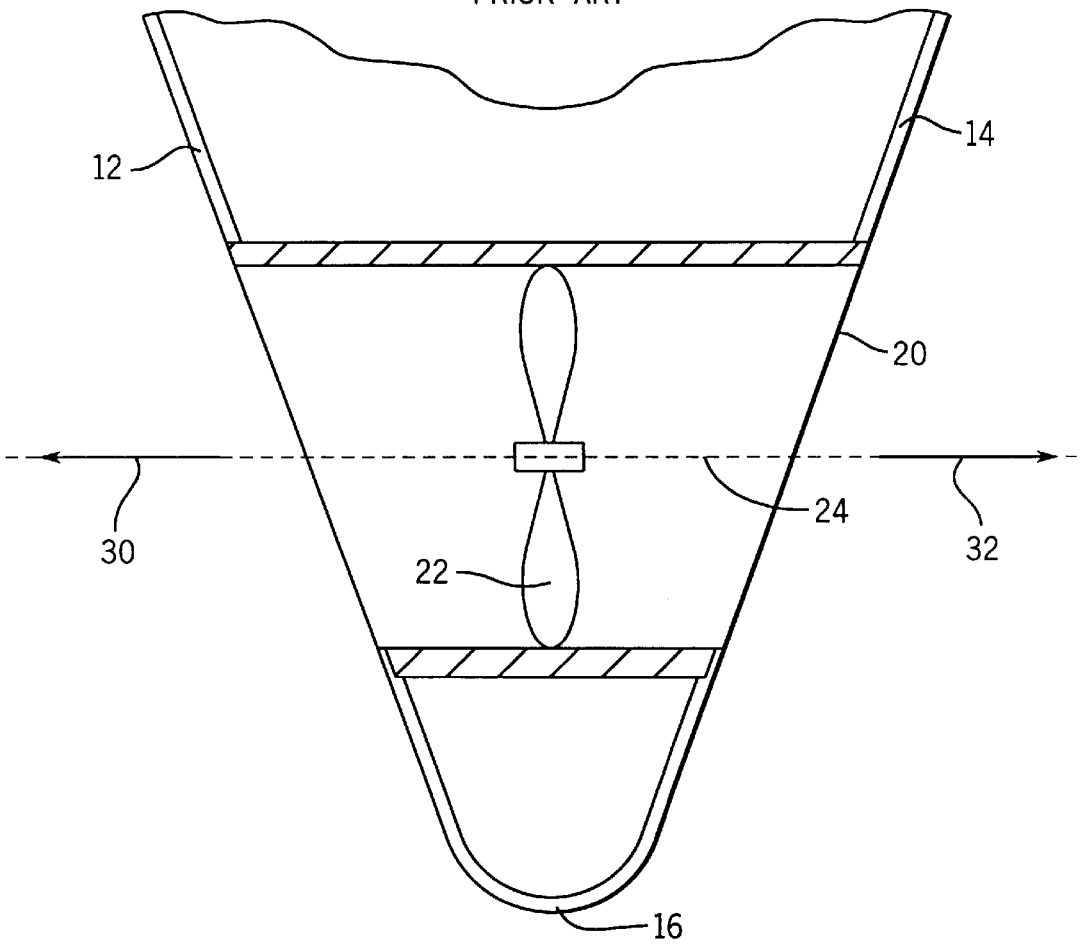
FIG. 1 PRIOR ART
FIG. 1 shows a section view through a bow of a marine vessel to illustrate a known type of thruster.

Throughout the description of the preferred embodiment of the present invention, like components will be identified by like reference numerals.

FIG. 1 shows a cross-section view taken through the bow and perpendicular to a centerline of a marine vessel. Reference numerals 12 and 14 identify the starboard and port sides of the marine vessel, and reference numeral 16 identifies the keel. A bow thruster device 20 forms a channel through the marine vessel at its bow. A propeller 22 is mounted for rotation in either a clockwise or a counterclockwise direction about a central axis 24. Rotation of the propeller 22 causes water to flow through the channel of the bow thruster 20 and, depending on the direction of rotation of the propeller 22, creates a thrust either towards starboard 30 or port 32. Bow thrusters of the type shown schematically in FIG. 1 are well known to those skilled in the art and can be used either as a bow thruster or a stern thruster.

Figure 2:
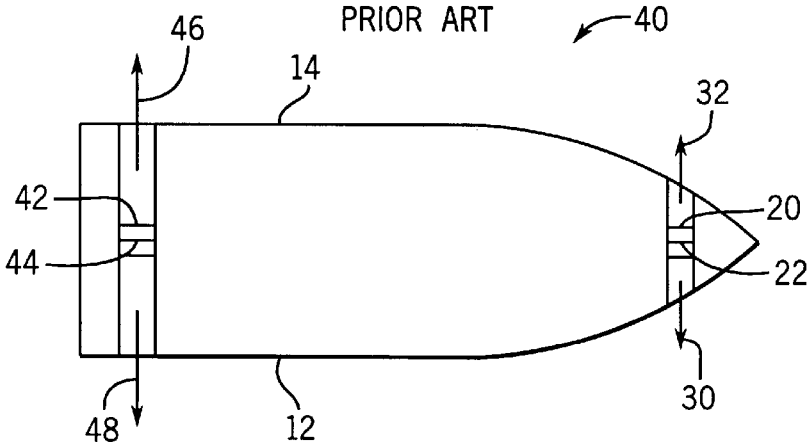
FIG. 2 PRIOR ART
FIG. 2 shows a section plan view of a marine vessel with a bow thruster and a stern thruster.

FIG. 2 shows the schematic layout of a marine vessel 40 with a bow thruster 20 and a stern thruster 42. Stern thruster 42 operates in the manner similar to the bow thruster 20, with a propeller 44 disposed within the channel that extends through the structure of the vessel from its port side 14 to its starboard side 12. The propeller 44 is able to rotate in either a clockwise or counterclockwise direction in order to exert a thrust on the vessel 40 in a direction either toward port 46 or starboard 48.

It can be seen in FIG. 2 that the use of bow thrusters and stern thrusters, in combination with each other, allows the operator of a marine vessel to exert thrusts on the vessel in any one of four possible directions which are all generally perpendicular to the centerline 50 of the vessel 40. By using the bow thruster 20 and the stem thruster 42 in tandem, the marine vessel can also be rotated about an effective center of rotation by rotating the two propellers, 22 and 44, in the appropriate directions to result in a thrust at the bow in one direction relative to the centerline 50 and a thrust at the stem in an opposite direction. Configurations such as that shown in FIG. 2, with known thrusters, are relatively expensive and require significant modification to the marine vessel. In addition, the thrusters inserted in the channels extending through the marine vessel are relatively large. For these reasons, bow thrusters and stem thrusters are typically only used on marine vessels of significant size.

Figure 3:
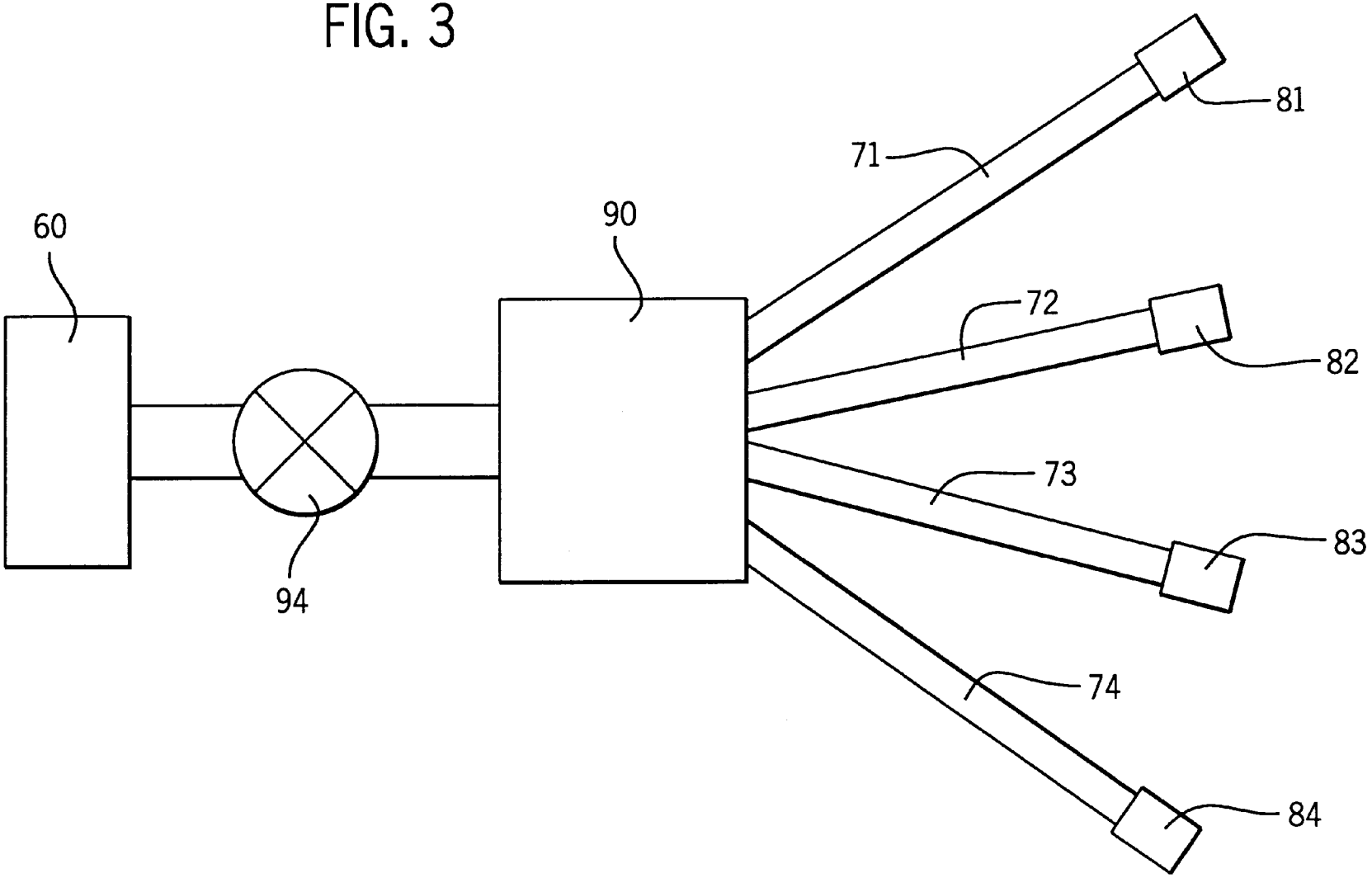
FIG. 3 is a highly schematic representation of the present invention.

FIG. 3 is a highly schematic representation of the basic components of the present invention. The marine propulsion system made in accordance with the present invention comprises a source 60 of pressurized water. The pressurized water source 60 can comprise a water pump which draws water from the lake, sea, or river on which the vessel is operated. Alternatively, the source of pressurized liquid can comprise at least a portion of a jet pump used as a primary propulsion system for the marine vessel. Either type of pressurized liquid source is possible within the scope of the present invention. A plurality of distribution conduits,71–74, which can be plastic tubing, receive water from the pressurized liquid source 60. A plurality of outlet conduits, 81–84, which can comprise nozzles, are connected to the distribution conduits to receive water therefrom. A liquid distribution controller 90 is connected in fluid control relation with each one of the plurality of distribution conduits 71–74. The liquid distribution controller is connected in fluid communication with the source of pressurized liquid 60 and each of the plurality of outlet conduits, 81–84, is attachable to a marine vessel at preselected locations for the purpose of directing a stream of liquid, which is flowing through associated ones of the pluralities of distribution conduits, 71–74, and outlet conduits, 81–84, in a predetermined direction associated with each of the outlet conduits for the purpose of imposing a force on the marine vessel in a direction opposite to that predetermined direction. In other words, if it is desired to move the marine vessel in a direction toward port, liquid is ejected through an appropriate outlet conduit in a direction toward starboard. In certain applications of the present invention, it is useful to provide a valve 94 to allow the operator of the marine vessel to inhibit all waterflow through the system. The use of a valve 94 can be particularly beneficial if the source of pressurized liquid 60 is at least a portion of the jet pump that provides the main propulsion for the marine vessel.

Figure 4:
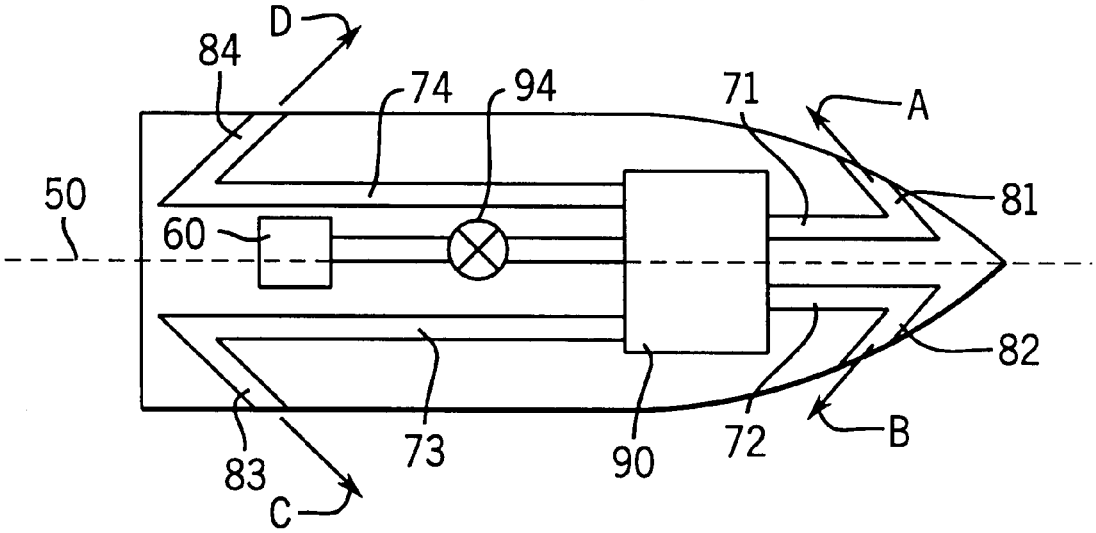
FIG. 4 is one embodiment of the present invention implemented in a marine vessel.

FIG. 4 shows one preferred embodiment of the present invention wherein the plurality of outlet conduits, 81–84, are attached to the hull of a marine vessel 40 in a manner which directs the streams of liquid from the outlet conduits in predetermined directions associated with each of the outlet conduits for the purpose of imposing a force on the vessel. For example, outlet conduit 81 is attached to the marine vessel in such a way that its stream of liquid is ejected in a direction represented by arrow A. It should be understood that the direction of the resulting thrust exerted on the vessel 40 is opposite to the direction of the stream of liquid A. Construction line 98 is shown in FIG. 4 to illustrate that the direction A of the stream of water emitted from the outlet conduit 81 is neither perpendicular to nor parallel with the centerline 50 of the marine vessel 40. Construction line 98 is perpendicular to line 50, and it can be clearly seen that the direction A of the stream of water emitted from outlet conduit 81 is at an angle which is neither parallel nor perpendicular to the centerline 50.

With continued reference to FIG. 4, the outlet conduit 82 is configured to direct a stream of water in a direction B, outlet conduit 83 is attached to the vessel 40 in a way that directs a stream of water in a direction C, and outlet conduit 84 is configured to direct a stream of water in a direction D.

A comparison of FIGS. 2 and 4 show certain basic differences between the prior art and the present invention. First, the embodiment of the present invention shown in FIG. 4 uses pressurized water in streams to exert a force on the vessel. Many types of known bow thrusters and stem thrusters use propellers for this purpose. Although not all known bow thrusters are restricted to the use of propellers, the most common types employ propellers that rotate clockwise and counterclockwise for these purposes. Secondly, the directions, A–D, of the streams of water are neither parallel nor perpendicular to the centerline 50 of the vessel. The known types of bow thrusters, particularly those which use propellers, direct their streams of water and resulting thrusts in directions which are perpendicular to the central axis 50. One advantage of the present invention is that forward and backward thrust can be provided without the necessity of resorting to the use of the main propulsion system of the vessel. In other words, if outlet conduits 81 and 82 direct their streams of water in directions A and B, a forward component of thrust will cause the marine vessel to move forward. Similarly, if outlet conduits 83 and 84 direct their streams of water in directions C and D, a rearward thrust is provided. The present invention therefore does not require the main propulsion system of the vessel to be implemented during docking maneuvers.

Figure 5:
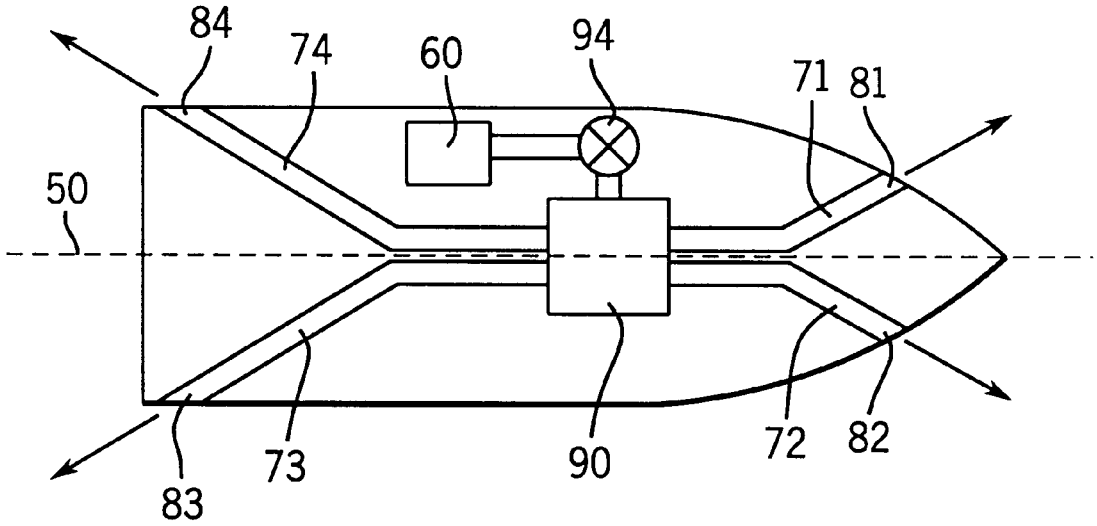
FIG. 5 is an alternative embodiment of the present invention implemented in a marine vessel.

FIG. 5 shows an alternative embodiment of the present invention which differs from the arrangement in FIG. 4 by the fact that the plurality of outlet conduits are directed in different directions. In both cases, which are shown in FIGS. 4 and 5, the directions of streams of liquid ejected from the outlet conduits are both non-parallel and non-perpendicular to the central axis 50 of the vessel. In addition, both systems can be used in combination with the liquid distribution controller 90 which will be described in greater detail below. Certain control advantages can be realized if the arrangement in FIG. 4 is used.

Figure 6:
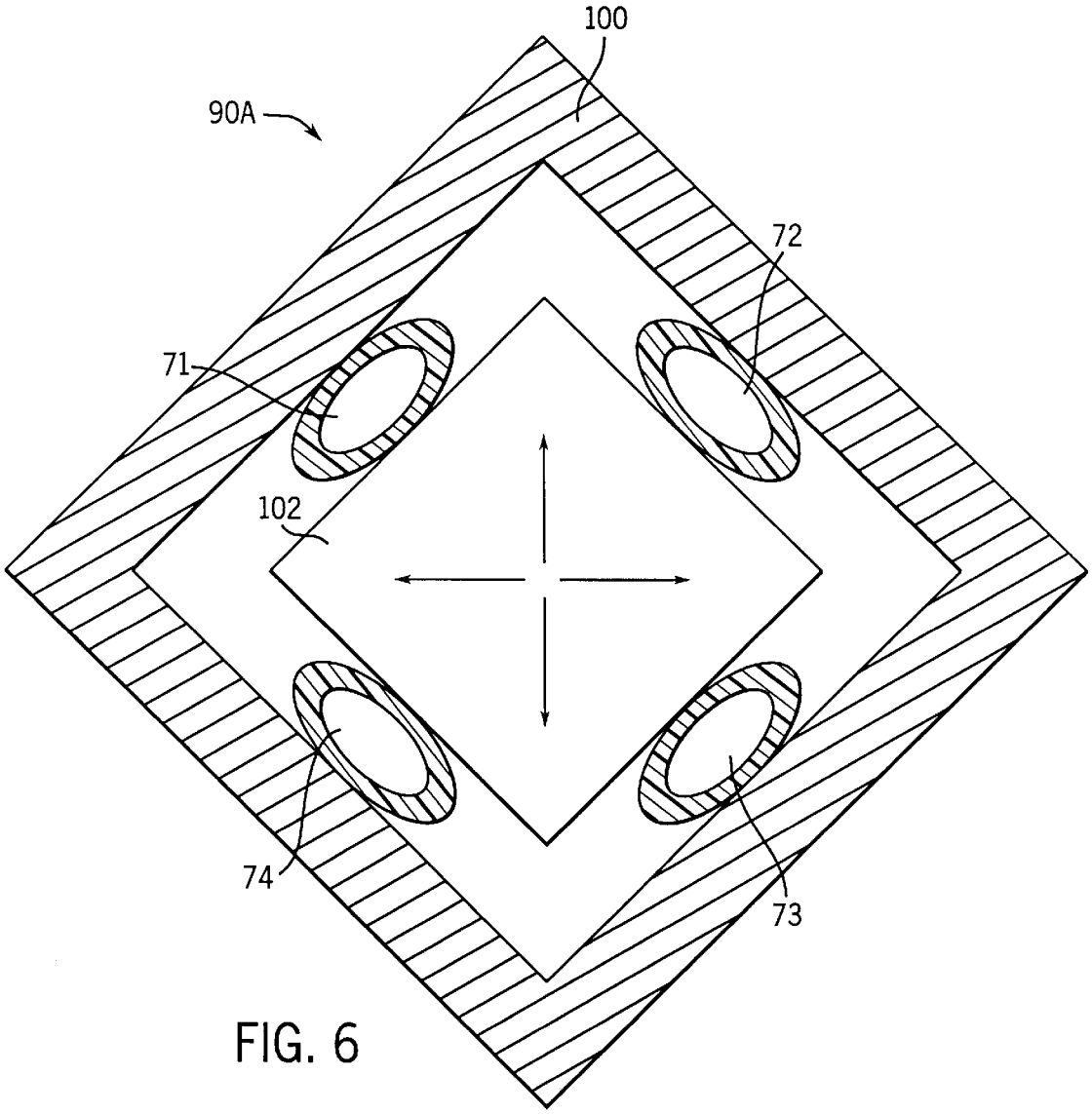
FIG. 6 is one embodiment of a liquid distribution controller useable with the present invention.

FIG. 6 shows a liquid distribution controller 90 configured in a way which is identified by reference numeral 90A. It comprises a stationary member 100 and a moveable member 102. The stationary and moveable members, 100 and 102, are depicted in FIG. 6 as being generally rectangular. The distribution conduits, 71–74, are disposed between the stationary and moveable members so that movement of the moveable member 102 will selectively constrict and dilate the portions of the distribution conduits, 71–74, extending between the stationary and moveable members. In other words, moving the moveable member 102 in an upward direction in FIG. 6 will constrict distribution conduits 71 and 72 and allow distribution conduits 73 and 74 to dilate. The dilation of the distribution conduits, when the moveable member is moved to release a compression force against them, occurs for two reasons. First, the distribution conduits in a preferred embodiment of the present invention are made of an elastic material. Secondly, the internal pressure within the distribution conduits provided by the source of liquid pressure 60 creates an internal force that assists in the dilation process. It is anticipated that the outer surfaces of all of the distribution conduits will remain in contact with both the stationary and moveable members at all times. The embodiment of the present invention shown in FIG. 6 does not provide an easy way to rotate the marine vessel either clockwise or counterclockwise about its center of gravity.

Figure 7:
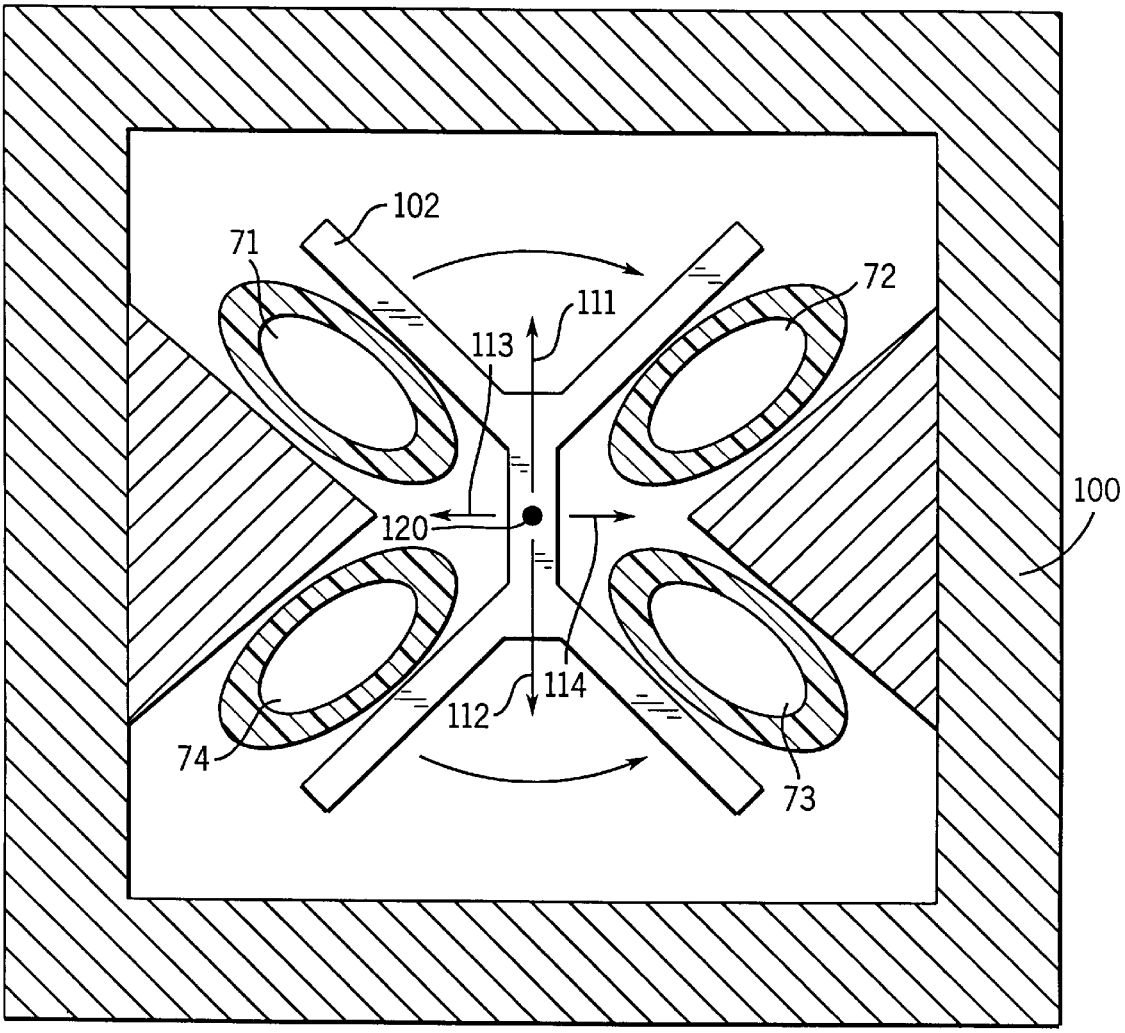
FIG. 7 is the preferred embodiment of a liquid distribution controller made in accordance with the present invention.

FIG. 7 shows an alternative embodiment, 90B, of the liquid distribution controller 90. With continued reference to FIG. 7, in combination with FIG. 4, it can be seen that movement of the moveable member 102 in the direction of arrow 111 will result in the constriction of distribution conduits 73 and 74 and the dilation of distribution conduits 71 and 72. This will cause fluid to flow in directions A and B in FIG. 4, but be restricted from flowing in directions C and D. This will cause a forward movement of the marine vessel 40. If the moveable member 102 is moved in the direction of arrow 112, on the other hand, distribution conduits 71 and 72 will be constricted, and distribution conduits 73 and 74 will be dilated. This will cause water to flow in directions C and D but not in directions A and B. A reverse movement of the vessel will result. If the moveable member 102 is moved toward the left, in the direction of arrow 113, distribution conduits 71 and 74 will be constricted, distribution conduits 72 and 73 will be dilated, water will flow in directions B and C but not A and D, and the marine vessel 40 will move toward port. The reverse is true if the moveable member 102 is moved toward the right in the direction of arrow 114 in FIG. 7. Distribution conduit 72 and 73 will be constricted, distribution conduit 71 and 74 will be dilated, water will flow in directions A and D but not B and C, and the marine vessel 40 will move in a direction toward starboard.

With continuing reference to FIG. 7, if the moveable member 102 is rotated about its centerpoint 120 in a clockwise direction, distribution conduit 72 and 74 will be constricted, distribution conduit 71 and 73 will be dilated, and water will be ejected in directions A and C. This will cause the marine vessel 40 to rotate in a clockwise direction similar to the direction of movement of the moveable member 102. An opposite rotation of the moveable member 102 in a counterclockwise direction will constrict distribution conduits 71 and 73, dilate distribution conduits 72 and 74, cause water to flow in directions B and D, resulting in the counterclockwise rotation of the marine vessel 40. The arrangement described above in conjunction with FIG. 7 is particularly suitable for adaptation to a joystick control system so that the operator's hand movements on the joystick will result in similar movement of the marine vessel.

Figure 8:
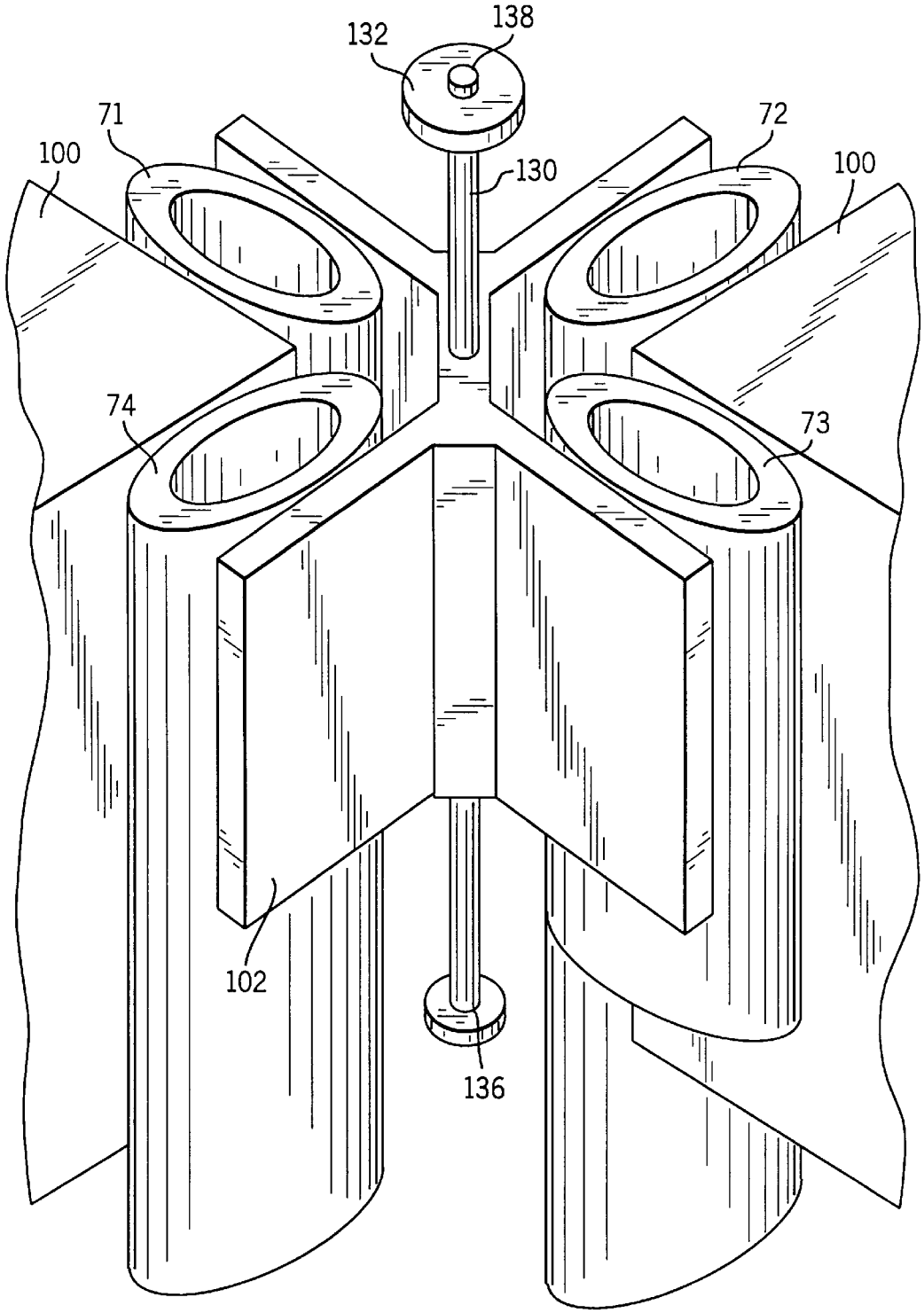
FIG. 8 is a perspective section view of the moveable and stationary members of a liquid distribution control made in accordance with the present invention.

FIG. 8 is a perspective section view of a portion of a liquid distribution controller employing a joystick to facilitate manual control of the maneuvering system. The moveable member 102 is attached to a joystick 130 which is provided with a handle 132. The joystick 130 is pivoted about a point 136, with the lengths of the joystick above and below the moveable member 102 being selected to provide an appropriate mechanical advantage to assist the operator in constricting the plurality of distribution conduits, 71–74. An arrangement such as that shown in FIG. 8 could be enhanced by providing a push button 138 on the handle 132 to allow the operator to activate and deactivate the valve 94 described above in conjunction with FIG. 3 and illustrated in FIGS. 4 and 5.

With reference to FIGS. 3 and 8, it should be understood that the four distribution conduits, 71–74, pass through the liquid distribution controller 90 in a way that causes the four distribution conduits to be separately disposed between selected portions of the moveable and stationary members. This allows a joystick controller or other appropriate device to selectively constrict and dilate the distribution conduits to allow manual control of the vessel for the purpose of docking and other types of maneuvering procedures.

The embodiment of the present invention described above uses a single source of liquid pressure, such as a dedicated water pump or the jet pump which is used as the primary propulsion device of the marine vessel, to provide the stream of water used to flow through the outlet conduits and provide the forces used to maneuver the marine vessel. An alternative embodiment of the present invention can use individual devices to create each of the streams of water.

Figure 9:
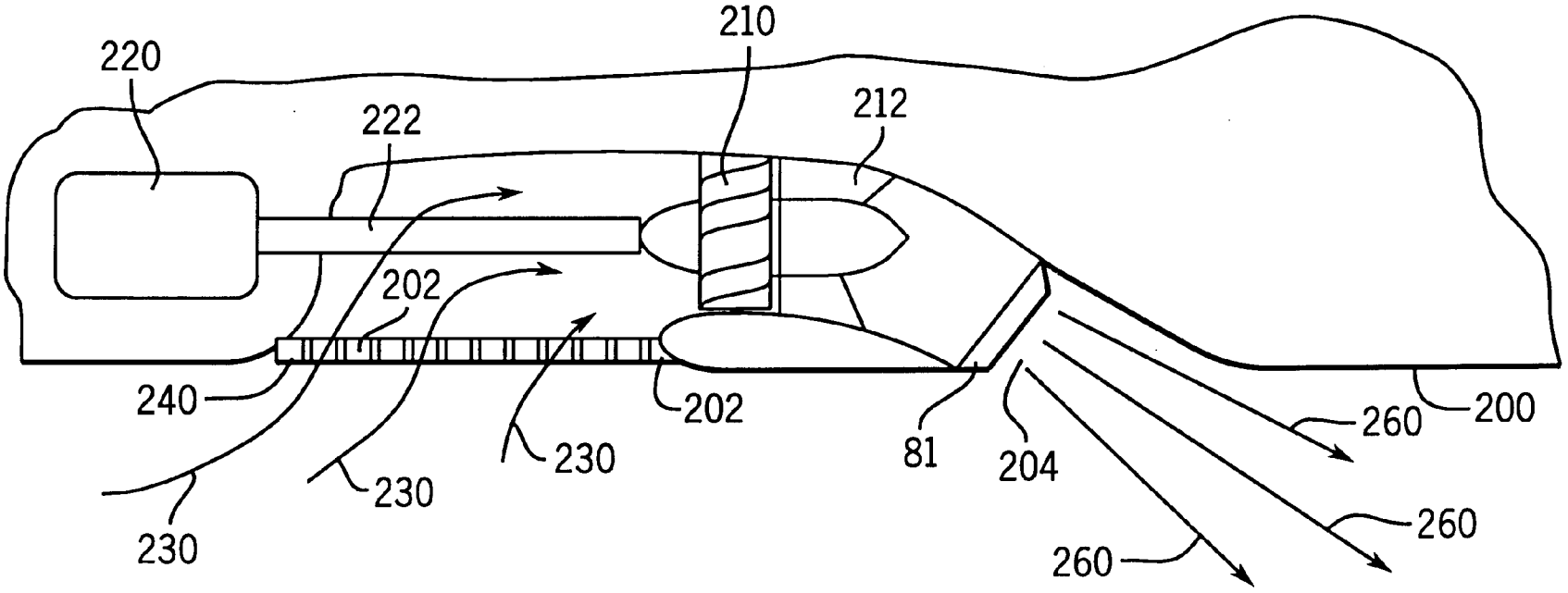
FIG. 9 shows one individual propulsion device which is used in an alternative embodiment of the present invention to provide a stream of water flowing outward from the hull of a marine vessel.

FIG. 9 shows a type of device that can be used in an alternative embodiment of the present invention. Inlet and outlet openings can be formed in the hull 200 of a boat. In the section of the hull shown in FIG. 9, an inlet opening 202 and an outlet opening 204 are formed in the side of the hull at a point which is below the water line when the boat is at rest and above the water line when the boat is on plane. In the schematic representation of FIG. 9, an impeller 210 and a stator 212 are arranged in a channel formed between the inlet 202 and the outlet 204. An electric motor 220 provides motive power through a shaft 222 to drive the impeller 210. Rotation of the impeller draws water into the inlet 202 as represented by arrows 230. In certain embodiments, a grate 240 can be placed over the inlet 202 to prevent leaves and debris from entering the propulsion unit. The impeller accelerates the water and causes it to flow out of the water outlet 81. The water flowing from the water outlet creates the force that enables an operator to maneuver a marine vessel.

Figure 10:
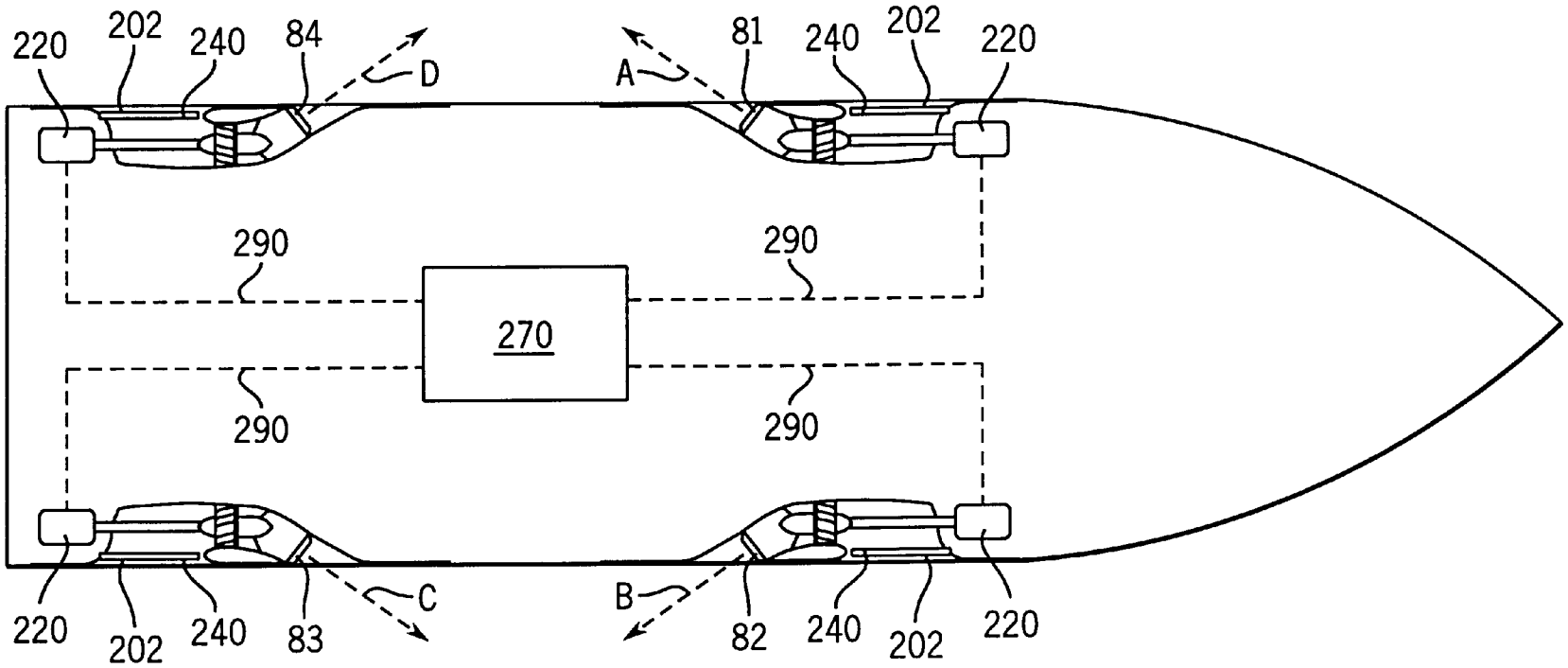
FIG. 10 shows a marine vessel with four propulsion devices attached to its hull at positions below the water line when the marine vessel is at rest and above the water line when the marine vessel is on plane.

FIG. 10 shows four devices, such as the one shown in FIG. 9, attached to a marine vessel. As described above, each of the stream producing mechanisms is attached to the marine vessel in such a way that the inlets and outlets are below the water line when the marine vessel is at rest, but above the water line when the marine vessel is on plane. The outlet stream of water, which is represented by arrows 260 in FIG. 9, are shown as dashed line arrows A–D in FIG. 10. Comparing FIG. 10 with FIGS. 4 and 5, it can be seen that the device illustrated in FIG. 9 can provide the streams of water from the port and starboard sides of the marine vessel to create the same effect which is provided by the source of pressurized water identified by reference numeral 60 in FIGS. 4 and 5 and described as a pump or the jet drive propulsion unit of the marine vessel. The embodiment of the present invention illustrated in FIG. 10 does not require a central source of water pressure. Instead, each of the individual propulsion units shown in FIG. 10 is provided with its own motor 220 and impeller system. A direction controller 270 is provided so that an operator of the marine vessel can control each of the individual propulsion units, either singly or in tandem with other propulsion units. Dashed lines 290 represent electrical connections between the direction controller 270 and each of the motors 220 of the four propulsion units. In a particular preferred embodiment of the present invention, the direction controller 270 employs a joystick that allows a boat operator to easily control the operations of the motors 220 to create streams of water, A–D, as needed to maneuver the vessel.

With continued reference to FIG. 10, it should be understood that the streams of water, A–D, can be directed in the directions shown in FIG. 10 and FIG. 4 or, alternatively, in the directions shown in FIG. 5. The advantages of directing the streams of water at the angles represented in FIGS. 4 and 5 have been described above in detail and will not be restated.

Figure 11:
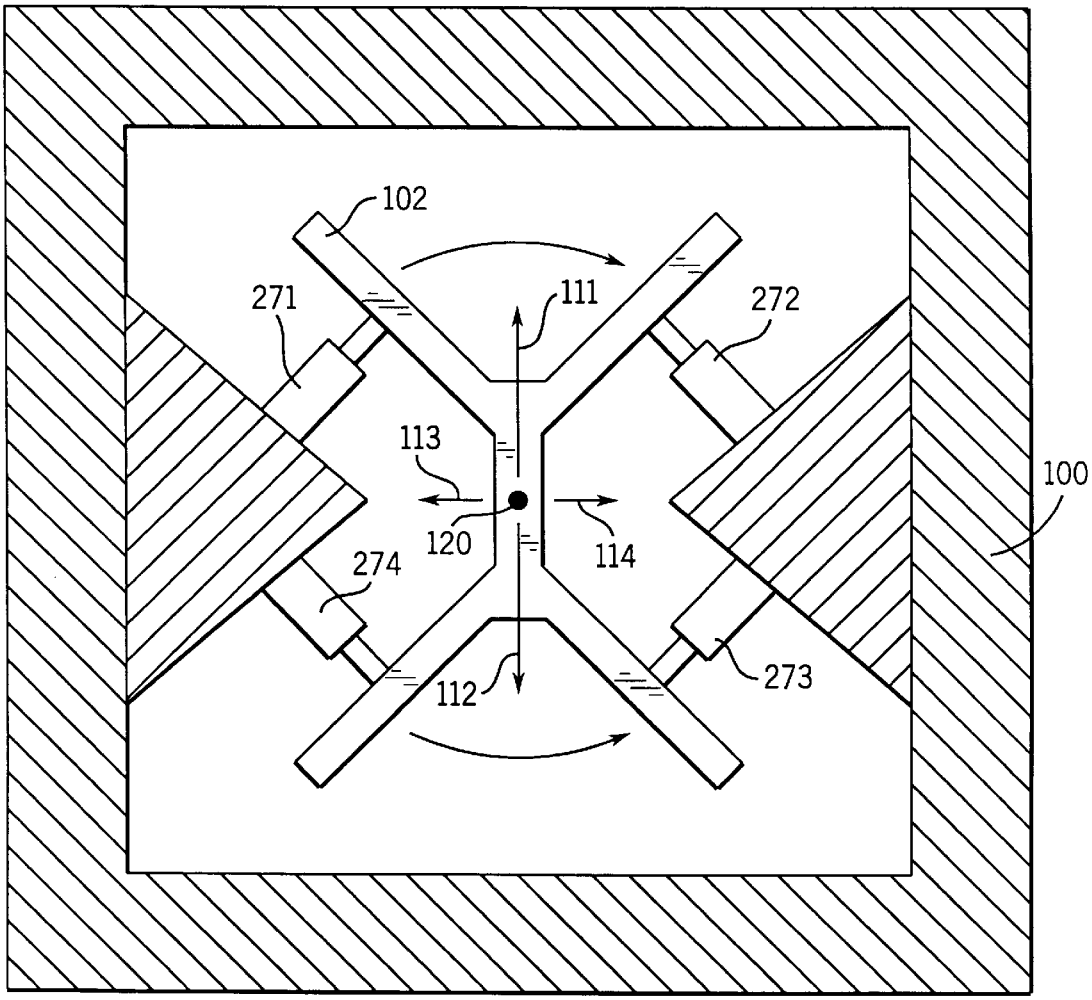
FIG. 11 shows a direction controller that is usable with the embodiment of the present invention shown in FIG. 10.

A direction controller joystick that is particularly applicable as a direction controller 270 shown in FIG. 10 is illustrated in FIG. 11. It uses similar stationary 100 and movable 102 components to those illustrated in FIG. 7. However, rather than having the conduits disposed in the spaces between the movable and stationary components, an electrical control device, such as a linear variable displacement transducer (LVDT) is located in the space between the movable and stationary devices. Although many different system designs are possible, the LVDT's can be designed into a circuit wherein compression of the two sections of the LVDT can reduce the current flowing to its associated motor. This type of arrangement would create a situation that is generally analogous in operation to the one illustrated in FIG. 7 with the conduits being constricted by movement of the movable member towards the stationary member. If an analogous arrangement is desirable, movement of the movable member towards the stationary member in FIG. 11, at the location of any one of the LVDT's would reduce the flow of the stream of water in the associated propulsion device shown in FIG. 10. However, it should be clearly understood that an opposite arrangement could also be used if the specific LVDT's in FIG. 11 are rearranged within the direction controller 270 as described below in conjunction with FIG. 12.

Although the embodiment of the present invention which is illustrated in FIGS. 9, 10 and 11 is different than the embodiment described above in conjunction with FIGS. 1–8, the overall benefit achieved by either embodiment is similar. The present invention allows a boat operator to maneuver the boat with the use of a simple direction controller that controls the activation of streams of water which flow from outlet conduits on the port and starboard sides of the marine vessel. In addition, all of the embodiments of the present invention direct the streams of water in directions which are neither parallel nor perpendicular to a center line of the marine vessel that extends from its bow to its stern. The primary difference between the embodiments illustrated in FIGS. 4 and 5 and the embodiment illustrated in FIG. 10 is that a central source of liquid pressure is used in the embodiments of FIGS. 4 and 5, whereas individual sources of water flow are used in the embodiment of FIG. 10. As a result, the present invention illustrated in FIG. 10 uses electrical controls to affect the maneuvering operation whereas the earlier embodiments use hydraulic controls that restrict or dilate conduits to change the rates of flow of liquid through them.

Figure 12:
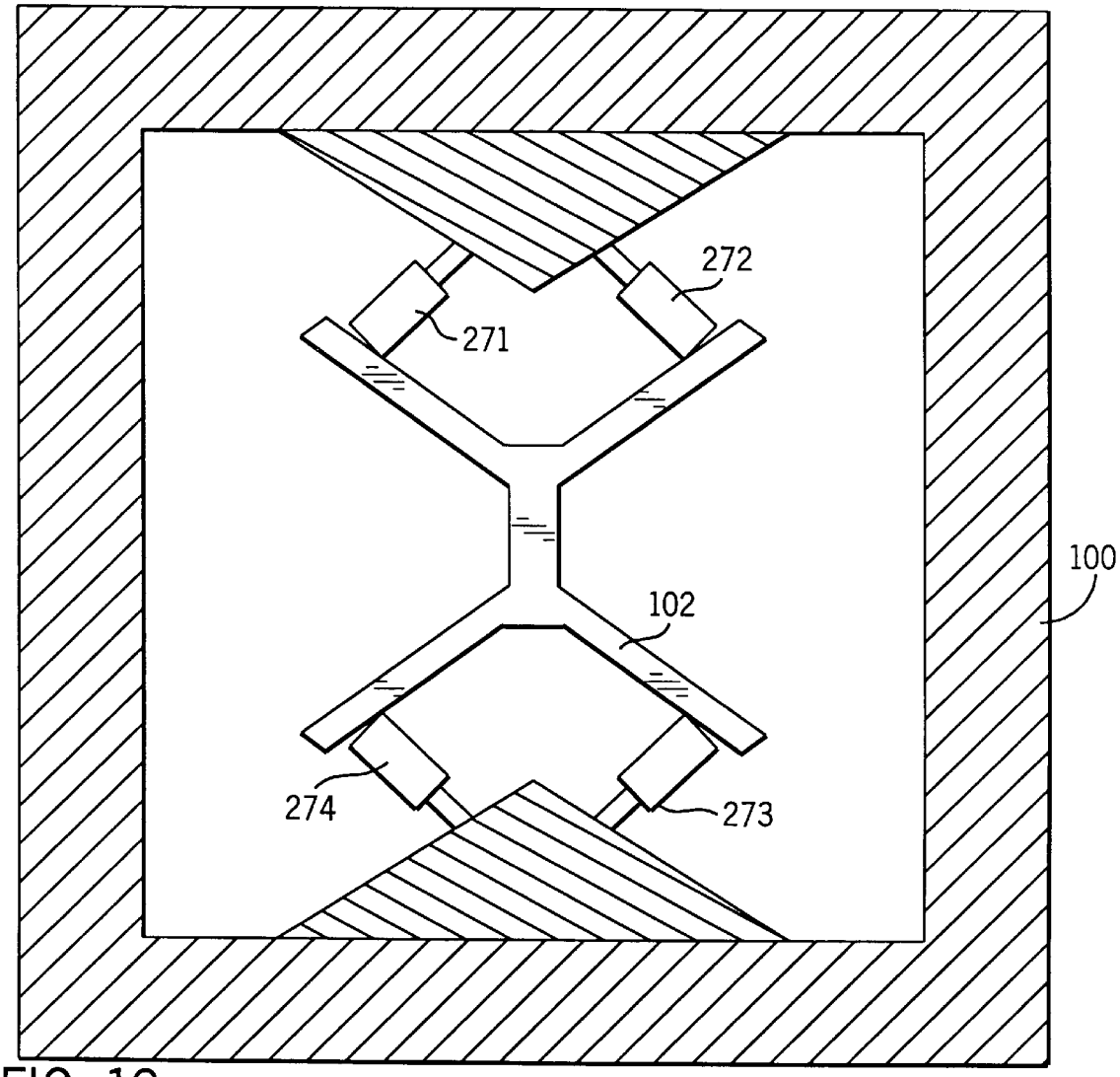
FIG. 12 is like FIG. 11 and also shows a direction controller that is usable with the embodiment of the present invention shown in FIG. 10.

As described above in conjunction with FIG. 11, the LVDT's can be arranged in a manner opposite to that shown in FIG. 11 to affect the LVDT's in a way that causes compression of the LVDT's to increase the flow of current through a motor associated with the LVDT. This arrangement is shown in FIG. 12 in which movement of the movable component 102 relative to the stationary component 100 will result in the same movement caused by the device shown in FIG. 11, as long as each of the LVDT's is connected electrically in a way that results in increased current flow to the associated motor when the LVDT is compressed between the movable and stationary components, 102 and 100.

Figure 13:
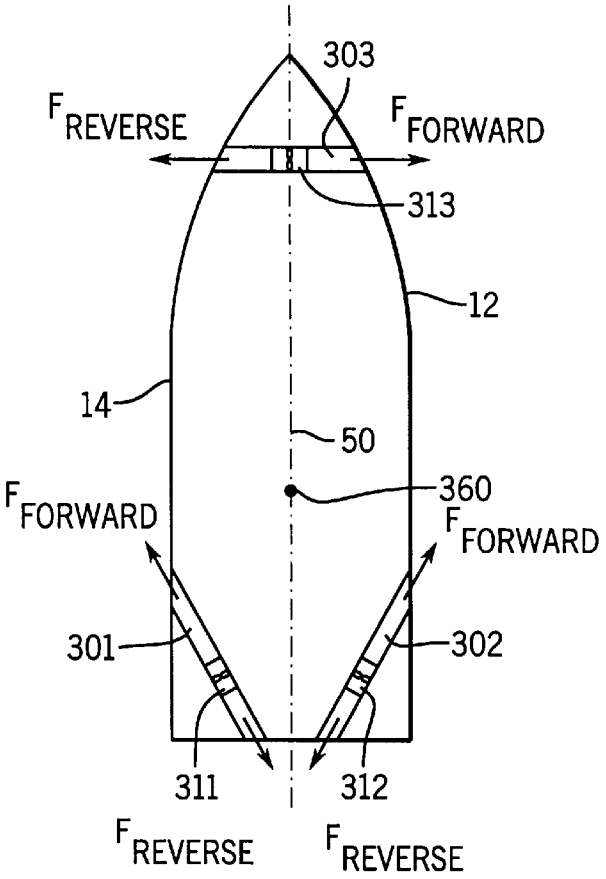
FIG. 13 is like FIG. 2 and shows a section plan view of a marine vessel with thrusters in accordance with the present invention.

Another embodiment of the present invention, which is illustrated in FIG. 13, utilizes a pair of outlet conduits, 301 and 302.In addition, a cross thrust conduit 303 is located near the bow of the marine vessel. The pair of outlet conduits, 301 and 302, are positioned in a way that the flow of fluid through the conduits results in a force on the marine vessel which is neither parallel nor perpendicular to a centerline 50 of the marine vessel. The cross thrust conduit 303 is mounted on the marine vessel to create a force on the vessel which is perpendicular to the centerline 50.

With continued reference to FIG. 13, it should be understood that each of the outlet conduits comprises an impeller within the conduit to cause water to flow through the conduit. In a preferred embodiment of the present invention, each of the impellers, 311, 312, and 313, is driven by a reversible motor. Since impellers and reversible motors are well known to those skilled in the art, further description of this arrangement is not required for one skilled in the art to understand the basic configuration within each of the outlet conduits in FIG. 13. However, it should be understood that the operation of the reversible motor, in either a forward or reverse direction, will cause a stream of water to flow through the associated outlet conduit and this flow of water will create a thrust on the marine vessel in a direction opposite to the direction of the flow of water. In FIG. 13, the arrows represent the forces on the marine vessel caused by the operation of the various reversible motors in either forward or reverse directions. For example, with specific reference to the cross thrust outlet conduit 303, the $F_{Forward}$ represents the direction of force on the marine vessel caused by operation of the impeller 313 by its associated reversible motor in a forward direction. Conversely, the $F_{Reverse}$ arrow in FIG. 13 represents the force on the marine vessel caused by operation of the reversible motor associated with impeller 313 in a reversed direction. The same nomenclature is used with regard to the outlet conduits 301 and 302. It can be seen that by controlling the operation of each of the impellers, 311–313, by either activating or deactivating the associated reversible motor and by selecting the direction of operation of the reversible motor, the operator has a choice of six directions of thrust that can be used, either singly or in combination with others, to maneuver the marine vessel. As an example, with reference to Table I below it can be seen that a truth table defines the effect on the marine vessel by operation of the various reversible motors and impellers in either a forward or reverse direction.

TABLE I

| Desired Direction of Movement | Cross Thrust Conduit | Port Outlet Conduit | Starboard Outlet Conduit |
|---|---|---|---|
| Reference Numeral | 303 | 301 | 302 |
| Clockwise | Forward | Forward | Reverse |
| Counterclockwise | Reverse | Reverse | Forward |
| Movement to Port | Reverse | Reverse | Forward |

TABLE I-continued

| Desired Direction of Movement | Cross Thrust Conduit | Port Outlet Conduit | Starboard Outlet Conduit |
|---|---|---|---|
| Movement to Starboard | Forward | Forward | Reverse |
| Forward | — | Forward | Forward |
| Astern | — | Reverse | Reverse |

With reference to FIG. 13 and Table I, it can be seen that the marine vessel can be moved in a clockwise direction by activating the cross thrust conduit 303 to produce a thrust identified as $F_{Foward}$ in FIG. 13, activating the port outlet conduit 301 to produce a force $F_{Foward}$ in FIG. 13, and to activate the starboard outlet conduit 302 to produce a force $F_{Reverse}$. It is important to note that the arrows in FIG. 13 represent the directions of force on the marine vessel and not the direction of flow of fluid through the outlet conduits. In fact, the flow of fluid through the outlet conduits is opposite to the resulting direction of force on the marine vessel caused by the flow of fluid.

Figure 14:
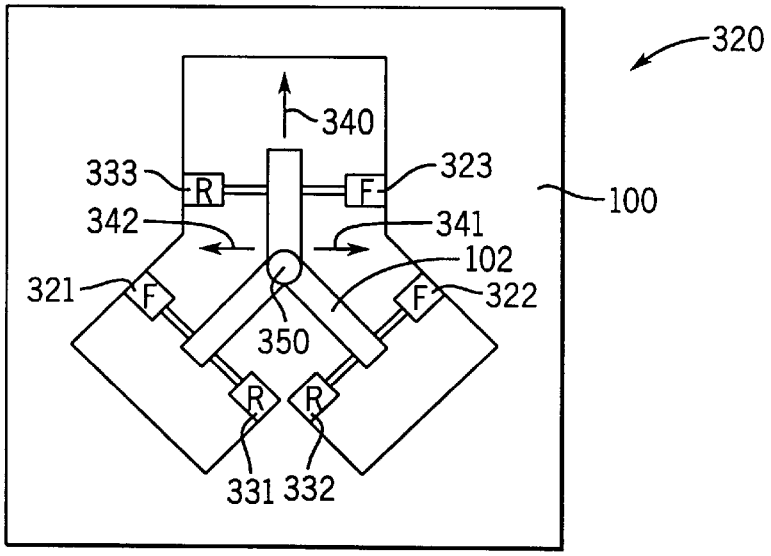
FIG. 14 is like FIG. 12 and also shows a direction controller in accordance with the present invention.

As can be seen in Table I, the marine vessel can be moved in any desirable direction by appropriately selecting the proper impeller, 311–313, and by properly selecting the direction of operation of the associated reversible motor. In order to facilitate this control, a direction controller 320 is shown in FIG. 14. A stationary component 100 and a movable component 102 are used in a matter that is generally similar to that described above in conjunction with FIG. 12. However, six LVDT's are used instead of the four shown in FIG. 12.

In FIG. 14, each of the LVDT's is identified with a letter, F or R to represent the forward or reverse direction of force desired for each of the impellers and reversible motors. For example, LVDT 321 will cause a current to be provided to the reversible motor associated with impeller 311 when it is depressed. The degree of activation of LVDT 321 will determine the magnitude of current provided to the reversible motor associated with impeller 311. Conversely, LVDT 331 will provide current to operate the same reversible motor associated with impeller 311, but in a reverse direction to cause a reverse force to be exerted on the marine vessel. In other words, activation of LVDT 321 creates the $F_{Foward}$ thrust on the marine vessel and LVDT 331 creates the $F_{Reverse}$ force on the marine vessel. LVDT's 323 and 333 are similarly associated with the cross thrust outlet conduit 303 and LVDT's 322 and 332 are similarly associated with outlet conduit 302 in FIG. 13.

With continued reference to FIG. 14, it can be seen that movement of the movable component 102 in the direction identified by arrow 340 will cause LVDT's 321 and 322 to be compressed and activated but will not affect LVDT's 323 and 333. This movement in the direction of arrow 340 will cause LVDT's 331 and 332 to be progressively deactivated from their status prior to movement of the movable component 102. Movement of the moveable component 102 in the direction of arrow 341 will progressively activate LVDT's 323, 322, and 331 while progressively deactivating each of the associated LVDT's. Movement of the moveable component 102 in the direction of arrow 342 will activate, or compress, LVDT's 321, 332, and 333 while progressively deactivating the other LVDT's. It can therefore be seen that movement of the moveable component 102 can be used to maneuver the marine vessel illustrated in FIG. 13. In addition, rotation of the moveable component 102 about its center point 350 will cause the marine vessel to rotate either clockwise or counterclockwise about its center of gravity 360. For example, if the moveable component 102 is rotated is a clockwise direction about its center point 350, LVDT's 323, 332, and 321 will be activated. This will result in forward forces on the marine vessel by the cross thrust outlet conduit 303 and the port outlet conduit 301 and will cause a reverse thrust on the marine vessel by the starboard outlet conduit 302. As also defined in Table I shown above, clockwise rotation of the moveable component 102 about its center point 350 will depress LVDT's 333, 322, and 331 to result in a counterclockwise rotation of the marine vessel because of the reverse force on the marine vessel by impeller 313, the reverse thrust on the marine vessel by impeller 311 and the forward thrust on the marine vessel by impeller 312.

The embodiment of the present invention shown in FIGS. 13 and 14 illustrate an application of the concept of the present invention which can be implemented through the use of three impellers and three associated reversible motors. The maneuvering of the marine vessel is accomplished by activating or deactivating one or more of the three outlet conduits shown in FIG. 13 and, additionally, by selecting either the reverse operation or forward operation of the associated reversible motor. The arrangement of the outlet conduits is particularly suited to the use of a joy stick control that employs the principals described above in conjunction with FIG. 14.

Although the present invention has been described with particular detail to illustrate several embodiments, it should be understood that alternative embodiments are also within its scope.

We claim:

1. A marine propulsion system, comprising:

a plurality of outlet conduits, each of said plurality of outlet conduits being attachable to a marine vessel at preselected locations to direct a stream of liquid, which can flow through each of said plurality of outlet conduits in a predetermined direction associated with each of said outlet conduits to impose a force on said marine vessel in a direction opposite to said predetermined direction;

means for causing said stream of liquid to flow through a preselected one of said plurality of outlet conduits;

a direction controller for selecting and activating said causing means associated with said preselected one of said outlet conduits, wherein said marine vessel has a centerline extending from its bow to its stern and said predetermined direction for at least one of said outlet conduits is in nonparallel and nonperpendicular relation with said centerline, wherein:

each of said outlet conduits is associated with one of a plurality of impellers to cause said stream of liquid to flow through it;

each of said plurality of impellers is connected in electrical communication with a motor; and each of said plurality of motors is connected in signal communication with said direction controller.

2. A marine propulsion system, comprising:

a plurality of outlet conduits, each of said plurality of outlet conduits being attachable to a marine vessel at preselected locations to direct a stream of liquid, which can flow through each of said plurality of outlet conduits, in a predetermined direction associated with each of said outlet conduits to impose a force on said marine vessel in a direction opposite to said predetermined direction;

means for causing said stream of liquid to flow through a preselected one of said plurality of outlet conduits;

a direction controller for selecting and activating said causing means associated with said preselected one of said outlet conduits, wherein said marine vessel has a centerline extending from its bow to its stern and said predetermined direction for at least one of said outlet conduits is in nonparallel and nonperpendicular relation with said centerline, wherein:

said causing means comprises a source of pressurized liquid and a plurality of distribution conduits, each of said distribution conduits being connected in fluid communication with an associated one of said plurality of outlet conduits;

said direction controller comprises a liquid distribution controller connected in fluid communication with each of said plurality of distribution conduits, said liquid distribution controller being connected in fluid communication with said source of pressurized liquid, each of said plurality of outlet conduits being attachable to a marine vessel at said preselected locations to direct said stream of liquid, which is flowing through associated ones of said pluralities of distribution conduits and outlet conduits, in said predetermined directions associated with each of said outlet conduits to impose said force on said marine vessel in said direction opposite to said predetermined direction; and said liquid distribution controller comprises a stationary member and a movable member which is controllable by an operator of said marine vessel, said plurality of distribution conduits being disposed to pass between said stationary and movable members so that relative movement between said stationary and movable members in any direction will cause said plurality of distribution conduits to be selectively constricted and dilated according to a predetermined pattern.

3. A marine propulsion system, comprising:

a source of pressurized liquid;

a plurality of outlet conduits;

a plurality of distribution conduits, each of said distribution conduits being connected in fluid communication with an associated one of said plurality of outlet conduits; and a liquid distribution controller connected in fluid communication with each of said plurality of distribution conduits, said liquid distribution controller being connected in fluid communication with said source of pressurized liquid, each of said plurality of outlet conduits being attachable to a marine vessel at preselected locations to direct a stream of liquid, which is flowing through associated ones of said pluralities of distribution conduits and outlet conduits, in a predetermined direction associated with each of said outlet conduits to impose a force on said marine vessel in a direction opposite to said predetermined direction, wherein:

said liquid distribution controller comprises a stationary member and a movable member which is controllable by an operator of said marine vessel, said plurality of distribution conduits being disposed to pass between said stationary and movable members so that relative movement between said stationary and movable members in any direction will cause said plurality of distribution conduits to be selectively constricted and dilated according to a predetermined pattern.

4. A marine propulsion system, comprising:

a source of pressurized liquid;

a plurality of outlet conduits;

a plurality of distribution conduits, each of said distribution conduits being connected in fluid communication with an associated one of said plurality of outlet conduits; and a liquid distribution controller connected in fluid communication with each of said plurality of distribution conduits, said liquid distribution controller being connected in fluid communication with said source of pressurized liquid, each of said plurality of outlet conduits being attachable to a marine vessel at preselected locations to direct a stream of liquid, which is flowing through associated ones of said pluralities of distribution conduits and outlet conduits, in a predetermined direction associated with each of said outlet conduits to impose a force on said marine vessel in a direction opposite to said predetermined direction, each of said plurality of outlet conduits comprising a nozzle for directing said stream of liquid in said predetermined direction, said liquid distribution controller comprising a stationary member and a movable member which is controllable by an operator of said marine vessel, said plurality of distribution conduits being disposed to pass between said stationary and movable members so that relative movement between said stationary and movable members in any direction will cause said plurality of distribution conduits to be selectively constricted and dilated according to a predetermined pattern.

5. The marine propulsion system of claim 4, wherein:

said source of pressurized liquid is a water pump.

6. The marine propulsion system of claim 4, wherein:

said source of pressurized liquid is a jet pump used as a primary propulsion system for said marine vessel.

7. The marine propulsion system of claim 4, wherein:

said marine vessel has a centerline extending from its bow to its stem and said predetermined direction for each of said outlet conduits is in nonparallel and nonperpendicular relation with said centerline.

8. The marine propulsion system of claim 7, wherein:

a first two outlet conduits of said plurality of outlet conduits are attached near the bow of said marine vessel and a second two outlet conduits of said plurality of outlet conduit are attached near the stem of said marine vessel, each of said first two outlet conduits being positioned to direct said stream of liquid in said predetermined direction associated with each of said first two outlet conduits which has a rearward component, each of said second two outlet conduits being positioned to direct said stream of liquid in said predetermined direction associated with each of said second two outlet conduits which has a forward component.

9. The marine propulsion system of claim 7, wherein:

a first two outlet conduits of said plurality of outlet conduits are attached near the bow of said marine vessel and a second two outlet conduits of said plurality of outlet conduit are attached near the stem of said marine vessel, each of said first two outlet conduits being positioned to direct said stream of liquid in said predetermined direction associated with each of said first two outlet conduits which has a forward component, each of said second two outlet conduits being positioned to direct said stream of liquid in said predetermined direction associated with each of said second two outlet conduits which has a rearward component.

10. A marine propulsion system, comprising:

a source of pressurized liquid;

a plurality of outlet conduits;

a plurality of distribution conduits, each of said distribution conduits being connected in fluid communication with an associated one of said plurality of outlet conduits; and a liquid distribution controller connected in fluid communication with each of said plurality of distribution conduits, said liquid distribution controller being connected in fluid communication with said source of pressurized liquid, each of said plurality of outlet conduits being attachable to a marine vessel at preselected locations to direct a stream of liquid, which is flowing through associated ones of said pluralities of distribution conduits and outlet conduits, in a predetermined direction associated with each of said outlet conduits to impose a force on said marine vessel in a direction opposite to said predetermined direction, each of said plurality of outlet conduits comprising a nozzle for directing said stream of liquid in said predetermined direction, said liquid distribution controller comprising a stationary member and a movable member which is controllable by an operator of said marine vessel, said plurality of distribution conduits being disposed to pass between said stationary and movable members so that relative movement between said stationary and movable members in any direction will cause said plurality of distribution conduits to be selectively constricted and dilated according to a predetermined pattern, said marine vessel having a centerline extending from its bow to its stern and said predetermined direction for each of said outlet conduits is in nonparallel and nonperpendicular relation with said centerline.

11. The marine propulsion system of claim 10, wherein:

said source of pressurized liquid is a water pump.

12. The marine propulsion system of claim 10, wherein:

said source of pressurized liquid is a jet pump used as a primary propulsion system for said marine vessel.

13. The marine propulsion system of claim 10, wherein:

a first two outlet conduits of said plurality of outlet conduits are attached near the bow of said marine vessel and a second two outlet conduits of said plurality of outlet conduit are attached near the stem of said marine vessel, each of said first two outlet conduits being positioned to direct said stream of liquid in said predetermined direction associated with each of said first two outlet conduits which has a rearward component, each of said second two outlet conduits being positioned to direct said stream of liquid in said predetermined direction associated with each of said second two outlet conduits which has a forward component.

14. The marine propulsion system of claim 10, wherein:

a first two outlet conduits of said plurality of outlet conduits are attached near the bow of said marine vessel and a second two outlet conduits of said plurality of outlet conduit are attached near the stern of said marine vessel, each of said first two outlet conduits being positioned to direct said stream of liquid in said predetermined direction associated with each of said first two outlet conduits which has a forward component, each of said second two outlet conduits being positioned to direct said stream of liquid in said predetermined direction associated with each of said second two outlet conduits which has a rearward component.

15. A marine propulsion system for a boat, comprising a plurality of thrusters providing a plurality of thrust forces, a central controller selectively actuating said thrusters to propel said boat selectively from the following menu of boat propulsion directions, each direction being selectively available to the operator:

a) forward;

b) rearward;

c) rightward;

d) leftward;

e) forward and rightward;

f) forward and leftward;

g) rearward and rightward;

h) rearward and leftward;

i) clockwise;

j) counterclockwise;

said central controller comprising a handle moveable by a novice operator intuitively along the following handle directions providing the following respectively recited boat propulsion directions:

a) forward handle movement to provide said forward boat propulsion direction;

b) rearward handle movement to provide said rearward boat propulsion direction;

c) rightward handle movement to provide said rightward boat propulsion direction;

d) leftward handle movement to provide said leftward boat propulsion direction;

e) forward and rightward handle movement to provide said forward and rightward boat propulsion direction;

f) forward and leftward handle movement to provide said forward and leftward boat propulsion direction;

g) rearward and rightward handle movement to provide said rearward and rightward boat propulsion direction;

h) rearward and leftward handle movement to provide said rearward and leftward boat propulsion direction;

i) clockwise handle movement to provide said clockwise boat propulsion direction;

j) counterclockwise handle movement to provide said counterclockwise boat propulsion direction.

16. The invention according to claim 15 comprising six said thrust forces, and wherein said menu of boat propulsion directions is provided entirely from said six thrust forces and entirely from said intuitively directed handle movement.

17. The invention according to claim 16 comprising three said thrusters, including a bow thruster and a pair of stern thrusters, each of said three thrusters providing two of said thrust forces.

18. The invention according to claim 17 wherein said central controller selectively actuates at least two of said thrusters at a time to create a force couple providing a boat propulsion direction selected from said menu.

19. A marine propulsion system for a boat having a center of gravity, comprising a plurality of thrusters providing a plurality of thrust forces, a central controller selectively actuating said thrusters to propel said boat selectively from the following menu of boat propulsion directions, each directions being selectively available to the operator:

a) forward;

b) rearward;

c) rightward;

d) leftward;

e) forward and rightward;

f) forward and leftward;

g) rearward and rightward;

h) rearward and leftward;

i) clockwise about said center of gravity;

j) counterclockwise about said center of gravity.

20. The invention according to claim 19 wherein movement of said boat defined by the following table, as defined in the specifications:

| Desired Direction of Movement | Cross Thrust Conduit | Port Outlet Conduit | Starboard Outlet Conduit |
|---|---|---|---|
| References Numeral | 303 | 301 | 302 |
| Clockwise | Forward | Forward | Reverse |
| Counterclockwise | Reverse | Reverse | Forward |
| Movement to Port | Reverse | Reverse | Forward |
| Movement to Starboard | Forward | Forward | Reverse |
| Forward | — | Forward | Forward |
| Astern | — | Reverse | Reverse. |

21. A marine propulsion system for a boat, comprising a plurality of thrusters providing a plurality of thrust forces, a central controller selectively actuating said thrusters to propel said boat selectively from the following menu of boat propulsion directions, each direction being selectively available to the operator:

a) forward;

b) rearward;

c) rightward;

d) leftward;

e) forward and rightward;

f) forward and leftward;

g) rearward and rightward;

h) rearward and leftward;

i) clockwise;

j) counterclockwise;

said central controller comprising a moveable handle and a stationary member and comprising a plurality of selectively constrictable and dilatable actuation members between said moveable handle and said stationary member, one of constriction and dilation of at least one of said actuation members reducing the respective said thrust force, and the other of said constriction and dilation of said one actuation member increasing said respective thrust force.

22. The invention according to claim 21 wherein said thrusters are provided by a plurality of liquid outlet conduits.

23. The invention according to claim 22 wherein said actuation members comprise liquid distribution conduits.

24. The invention according to claim 21 wherein said actuation members comprise electrical control devices.

25. The invention according to claim 24 comprising six said thrust forces and wherein said menu of boat propulsion directions is provided entirely from said six thrust forces, and comprising three said thruster, including a bow thruster and a pair of stern thrusters, each of said three thrusters providing two of said thrust forces, and further comprising a minimum of six of said actuation members, each being an electrical control device actuatable by movement of said handle.

26. The invention according to claim 25 wherein said handle is moveable by a novice operator intuitively along the following handle directions providing the following respectively recited boat propulsion directions:

a) forward handle movement to provide said forward boat propulsion direction;

b) rearward handle movement to provide said rearward boat propulsion direction;

c) rightward handle movement to provide said rightward boat propulsion direction;

d) leftward handle movement to provide said leftward boat propulsion direction;

e) forward and rightward handle movement to provide said forward and rightward boat propulsion direction;

f) forward and leftward handle movement to provide said forward and leftward boat propulsion direction;

g) rearward and rightward handle movement to provide said rearward and rightward boat propulsion direction;

wherein movement of said handle in any of said handle directions on said menu actuates at least two of said electrical control devices and couples at least two of said thrust forces.

27. The invention according to claim 21 wherein said thrusters are hydraulic.

28. The invention according to claim 21 wherein said thrusters are hydraulically controlled.

29. The invention according to claim 21 wherein said thrusters are electric.

30. The invention according to claim 21 wherein said thrusters are electrically controlled.

h) rearward and leftward handle movement to provide said rearward and leftward boat propulsion direction;

i) clockwise handle movement to provide said clockwise boat propulsion direction;

j) counterclockwise handle movement to provide said counterclockwise boat propulsion direction.

* * * * *